United States Patent [19]

Iantorno

[11] 4,450,622

[45] May 29, 1984

[54] MOLDED SHORTING JACK

[75] Inventor: James Iantorno, Mamaroneck, N.Y.

[73] Assignee: Sealectro Corporation, Mamaroneck, N.Y.

[21] Appl. No.: 371,431

[22] Filed: Apr. 23, 1982

[51] Int. Cl.[3] ..... H01R 31/08

[52] U.S. Cl. ..... 29/842; 339/19; 339/59 R

[58] Field of Search ..... 339/59 R, 59 M, 217 S, 339/19, 61 R, 98; 29/843, 844, 842, 845, 829

[56] References Cited

U.S. PATENT DOCUMENTS 3,990,759 11/1976 Crowe ..... 339/59 R 4,190,308 2/1980 Iantorno ..... 339/19

4,283,100 8/1981 Griffin et al. ..... 339/19

4,359,253 11/1982 Iantorno ..... 339/19

*Primary Examiner*—William R. Briggs

*Attorney, Agent, or Firm*—Anthony J. Casella; Gerald E. Hespos

[57] ABSTRACT

A housing for an electrical connector includes a rectangular outer shell, a rectangular cavity disposed within the outer shell, and a cylindrical hub formed integrally with the upper surface of the outer shell and extending outwardly therefrom. An annular electrical contact is disposed within the cavity, and the cylindrical hub is driven inwardly into the cavity such that the contact surrounds the hub, the hub sheering from the upper surface of the outer shell. The hub fits snuggly into a pair of apertures formed in the upper and lower surfaces of the outer shell.

12 Claims, 6 Drawing Figures

MOLDED SHORTING JACK

BACKGROUND OF THE INVENTION

The present invention is directed to a shorting jack or electrical connector used in switching, connecting, or programming electronic circuitry. Typically, circuit elements contained on a printed circuit board may be connected to electrically conductive pin members which extend at right angles from the surface of the printed circuit board. Many times, it is desirable to electrically connect a pair of such pin members on the printed circuit board. Known devices for effecting this electrical connection typically comprise female electrical connectors or shorting jacks. The jacks generally consist of an electrically non-conductive housing which encases a generally U-shaped conductor, the leg portions of the U-shaped conductor being disposed in female sockets or receptacles for receiving the pair of pin members, the connection between the pin members being effected by the U-shaped conductor.

One such connector is disclosed in U.S. Pat. No. 4,283,100 by Griffin et al. Disclosed therein is a connector having a non-conductive casing having a pair of the above-described receptacles into which a "horseshoe" shaped conductor is disposed. The horseshoe shaped conductor is retained in the housing by means of an inclined portion over which the conductor is forced during insertion of the conductor into the housing.

Although the above-described shorting jacks function properly, the cost of the jacks, especially the production costs, have been found to be prohibitively high for many applications. The high production costs have, in major part, been caused by the necessity of orienting the U-shaped or horseshoe shaped conductors prior to insertion into the casing. The step of properly orienting the conductor requires an undue amount of manipulation of the conductors, and does not readily lend itself to mass production techniques.

A significant improvement over the above-described techniques for providing shorting jacks is disclosed in U.S. Pat. No. 4,190,308 by Iantorno, and assigned to the assignee of the present invention. Described therein is a connector which employs a continuous annular conductive contact member which is disposed about a hub portion of a housing in loose fit relationship. The spaced apart, parallel, electrically conductive pin members are adapted to come into contact with the annular contact member during the mounting of the connector onto the pins, such that the annular contact member deforms bebetween the pins in the form of an oval or ellipse. Unlike the connector employed by Griffin et al., the contact member disclosed by Iantorno does not have to be oriented prior to insertion into the connector housing, due to its annular shape.

The annular contact described by Iantorno is inserted into the connector housing by being forced over specifically configured openings in the housing. When so forced, the contact member deforms, slips unto the central hub in loose fitting relationship, and is free to expand to its normal position such that it is retained within the housing. Although this technique of inserting the contact into the housing is superior to that described by Griffin et al., it is still desirable to reduce the complexity of the contact insertion operation to thereby accordingly reduce production costs in preparing the connectors.

OBJECTS AND SUMMARY OF THE INVENTION

It is therefore an object of the present invention to provide a shorting jack housing which readily accepts an annular contact member without having to exert any insertion force on the contact member in fabricating the connector.

It is a further object of the invention to provide a molded shorting jack housing which readily lends itself to the production of shorting jacks utilizing high speed, mass production techniques.

It is a further object of the invention to provide a process for preparing a shorting jack in which the contact inserted into the housing need not be forced or deformed.

It is a further object of the invention to provide a process for rapidly and economically producing a shorting jack which readily lends itself to mass production techniques.

In accordance with a first aspect of the invention, a housing for an electrical connector comprises an outer shell, a cavity disposed within the outer shell and adapted to receive a generally annular electrical contact, and a hub extending outwardly from the outer shell and adapted to be driven inwardly into the cavity such that the contact surrounds the hub.

According to the specific embodiments, the contact is generally round and the hub is generally cylindrical and integrally formed with the outer shell, the hub and the outer shell joined at a generally annular strip of material adapted to shear when the hub is driven into the cavity. Preferably, the outer shell and the cavity are generally rectangular in shape, and the generally annular strip of material is formed in a top wall of the outer shell. A first generally circular aperture is formed in a bottom wall opposite the top wall, wherein the bottom portion of the hub is adapted to fit snuggly into the aperture when the hub is driven into the cavity. The top wall is adapted to provide a second generally circular aperture into which the upper portion of the hub is adapted to snuggly fit after the hub is driven into the cavity.

In accordance with more specific embodiments, the hub may be provided with a substantially vertically disposed hole therethrough to provide a convenient means of extracting a connector from a circuit and to allow a pin tool to be inserted to insure an even shearing and square entry of the hub into the first aperture. The upper portion of the hub may be further provided with a horizontally disposed groove therethrough to aid in automatic orientation of the housings. Finally, tab means may be secured to the outer shell, extending outwardly therefrom, in order to facilitate the easy application of the connector to the appropriate pins.

According to a second aspect of the invention, a process for forming an electrical connector includes the steps of disposing a generally annular electrical contact in a cavity formed in an outer shell having a hub extended outwardly from an upper surface of the outer shell, and driving the hub inwardly into the cavity such that the contact surrounds the hub.

More specifically, the step of driving the hub into the cavity comprises the step of shearing the hub from the upper surface of the outer shell. The step of driving further includes driving the bottom portion of the hub into a first aperture provided in a lower surface of the outer shell, the bottom portion of the hub fitting snuggly within the first aperture. The step of driving may still further include the step of leaving a second aperture in the upper surface of the outer shell into which the upper portion of the hub snuggly fits after the hub is driven into the cavity. The step of disposing may comprise the step of moving the contact into the cavity with a shuttle, and leaving the shuttle in the cavity during the step of driving. Finally, the process may further include the step of disposing a pin tool in a substantially vertical through hole in the hub prior to, and during the step of driving to insure an even shearing of the hub from the upper surface of the outer shell and square entry of the lower portion of the hub into the first aperture.

BRIEF DESCRIPTION OF THE DRAWINGS

These and other objects and aspects of the invention will be more fully described with reference to the following drawing figures of which.

DETAILED DESCRIPTION OF THE INVENTION

Figure 1:
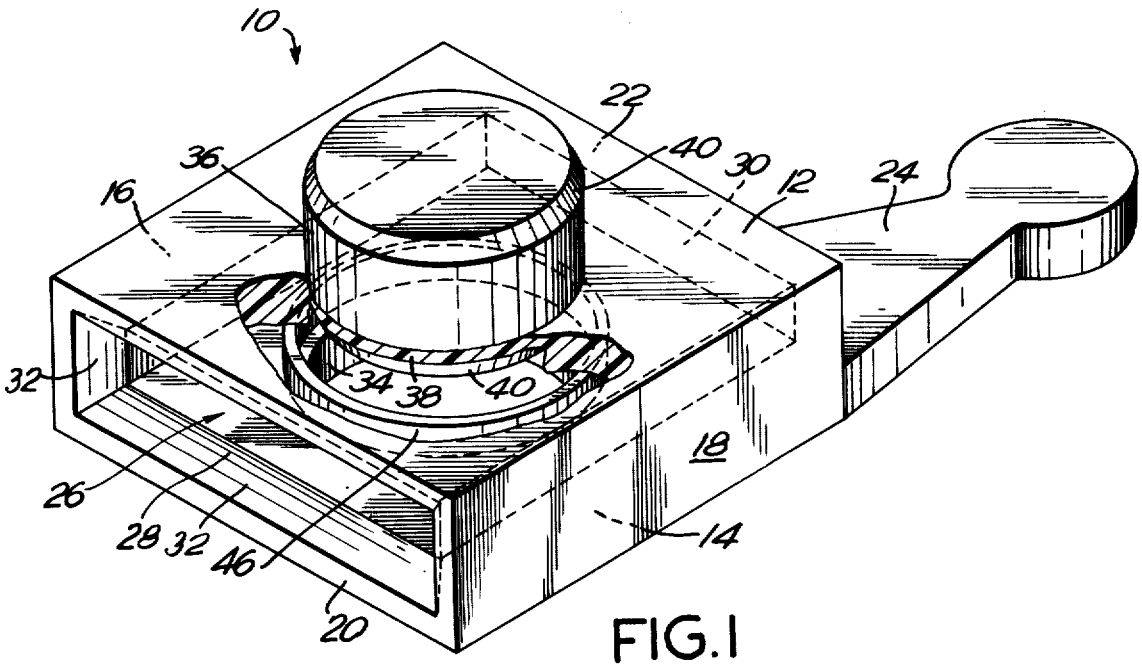
FIG. 1 is a perspective view of the molded shorting jack housing according to the present invention prior to the formation of the completed shorting jack.
Figure 2:
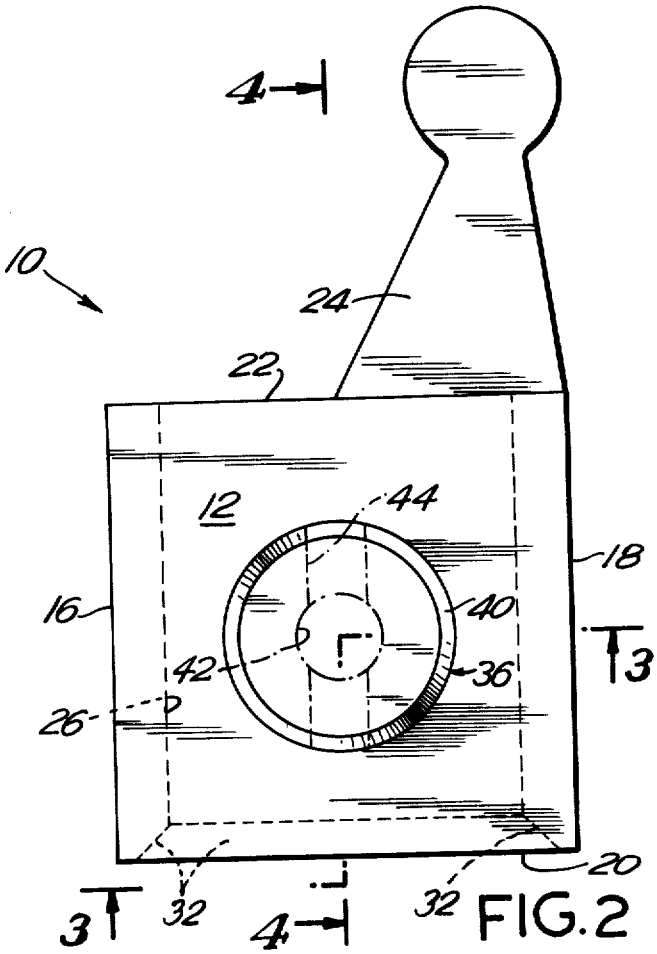
FIG. 2 is a top plan view of the molded shorting jack housing illustrated in FIG. 1.
Figure 3:
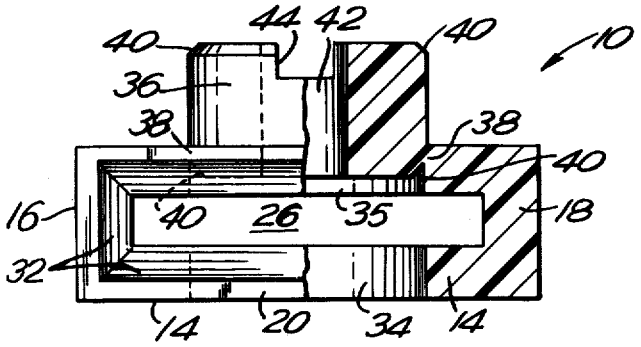
FIG. 3 is a front, partial cross sectional view taken through section 3—3 of the molded shorting jack housing illustrated in FIG. 2.

With reference to FIGS. 1-3, the molded shorting jack housing 10 includes an outer shell formed by generally parallel top and bottom walls 12 and 14, respectively, substantially parallel left and right side walls 16 and 18, respectively, each of which is substantially perpendicular to top and bottom walls 12 and 14, and substantially parallel front and rear walls 20 and 22, respectively, each of which is substantially perpendicular to both the top and bottom walls and the left and right side walls. Extending outwardly from back wall 22 is tab 24 which lies in the same general plane as the bottom wall 14. Formed within the outer shell of housing 10 and bounded within the top, side and front and rear walls, is a central cavity 26 of substantially rectangular shape, the top, bottom and side surfaces of the cavity 26 being substantially parallel to walls 12, 14, 16 and 18, respectively. The front and rear walls 20 and 22, are each provided with generally rectangular apertures 28 and 30, respectively, through which the central cavity 26 communicates with the exterior of the housing. Aperture 28 is V-shaped, such that the interior surfaces 32 formed by aperture 28 are inclined toward the central cavity, to thus facilitate the entry of the pin contacts into the housing.

As best illustrated in FIG. 3, bottom wall 14 is provided with a generally circular bottom aperture 34, while top wall 12 is provided with frangible hub portion 36 attached thereto. Hub portion 36 is generally cylindrical in shape, conforming to the shape of aperture 34, and is connected to top wall 12 by way of a thin annular strip of material 38 about the lower periphery of hub portion 36. Top aperture 35 is formed below the hub 36 and is in substantial vertical alignment with bottom aperture 34. The upper and lower corners of the hub 36 may be provided with chamfers 40, an optional central bore 42 extending through the cylindrical axis of the hub 36 and an optional slot 44 formed within the top surface of the hub 36, extending through the length of the hub in a direction parallel to the side walls 16 and 18.

Figure 4A:
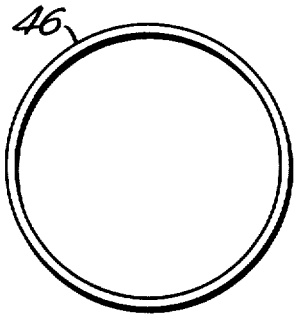
FIG. 4A is a top plan view of the annular contact employed in the molded shorting jack according to the present invention.
Figure 4B:
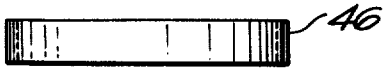
FIG. 4B is a front view of the annular contact illustrated in FIG. 4A.
Figure 5:
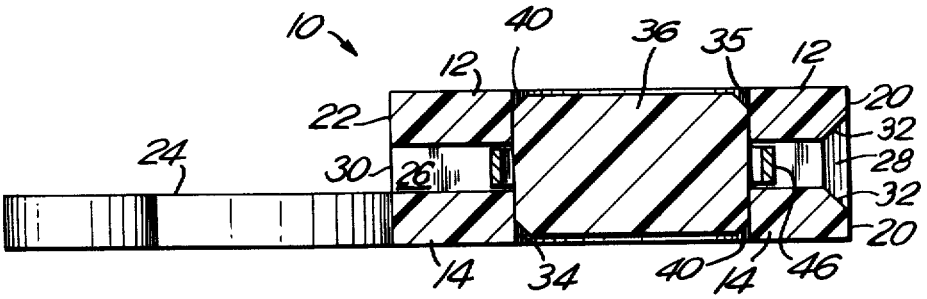
FIG. 5 is a side cross sectional view of the molded shorting jack and annular contact in completed form.

In operation, the annular contact 46 illustrated in FIGS. 4A and 4B is shuttled into the central cavity 26 by an active shuttle (not shown) and stopped by a counter shuttle (also not shown) such that it is centered underneath hub 36. With at least one of the active or counter shuttles preferably remaining in the cavity 26 to prevent the top wall 12 from deforming or fracturing, the hub 36 is forced downwardly into cavity 46 by applying pressure or a sharp blow to the top of the hub. If the central bore 42 is provided in the hub 36, a pin tool may be inserted therein prior to and during this step to insure an even breakaway of the hub and square entry into aperture 34. The annular strip 38 is fractured allowing the hub to move downwardly into the cavity and eventually into aperture 34, to produce the end result illustrated in FIG. 5. The chamfer 40 on the bottom of the hub portion leads the hub into the aperture 34 where it is secured by an interferance fit between its outside diameter, aperture 34 and aperture 35. The remaining shuttle or shuttles are then removed from the cavity and the connector is completed.

It will be apparent to those skilled in the art that the connector housing according to the present invention provides an extremely efficient technique for providing the end product as jsut described. Specifically, the housing geometry offers the option of continuous plastic molding to thus provide practical gains in strip feeding. Further, the advantages of increased housing feed rate and natural orientation through continuous molding may be realized. Since the ring contacts do not require orientation, they can be bulk loaded into a hopper feed, thus eliminating the disadvantages of strip feeding as required with the Griffin et al. device, such as bending, snagging and machine jamming.

Still further, a variety of advantages are attainable due to the configuration of the housing prior to the insertion of the contact and subsequent shearing of the hub portion. Since the hub 36 protrudes upwardly from the top wall 12, it can be used to sense attitude of the housing (up or down). By further providing the groove 44, the housing may be further oriented in the event that loose parts are fed. The groove 44 would be especially helpful if the tab 24 were not provided on the connector. The bore 42 may be provided for facilitating the extraction of the connector from a circuit. The bore also makes the hub more resilient and, when used in conjunction with a pin tool, insures even break away and square entry into aperture 34 during the formation process.

Although the annular contact member 46 may be formed by any suitable technique, it has been found that drawing is the best technique for reducing cost without sacrificing performance. The drawn contacts do not require chemical or mechanical deburring, thus eliminating the cost of secondary operations. Also, by selectively plating the contact strip prior to fabricating, the cost may be further reduced, particularly in the case of gold plating.

Although the present invention has been described with reference to the foregoing preferred embodiments and examples of the present invention, it will be apparent to those skilled in the art that many modifications and changes may be made therein without departing from the spirit and scope of the invention. It is to be understood that the examplary embodiments are illustrative, and not restrictive of the invention, the scope of which is defined in the appended claims, and that all modifications that come within the range of equivalency of the claims are intended to be included therein.

What is claimed is:

1. A process for forming an electrical connector comprising the steps of:

providing a generally annular electrical contact;

providing an outer shell having opposed upper and lower surfaces and a cavity therebetween, with a hub integrally formed in the upper surface and extending outwardly therefrom and an aperture in the lower surface;

disposing the contact in the cavity of the outer shell;

driving said hub inwardly into said cavity such that said hub shears from said upper surface of said outer shell;

driving said hub further into said cavity such that said contact surrounds said hub; and driving a portion of said hub into said aperture in the lower surface of said outer shell, whereby said portion of said hub snugly fits within said aperture.

2. A housing for a generally annular electrical contact, said housing comprising an outer shell, a cavity disposed within said outer shell and dimensioned to receive the generally annular electrical contact, and a hub extending outwardly from said outer shell and integrally joined thereto by a generally annular strip of material, said generally annular strip of material being dimensioned to shear when an inwardly directed force is applied to the hub, whereby when the generally annular electrical contact is placed in the cavity and when an inwardly directed force is applied to the hub, and the hub will be sheared from the outer shell and will be driven inwardly into said cavity such that said contact surrounds said hub.

3. The housing of claim 2 wherein said outer shell and said cavity are generally rectangular in shape.

4. A housing for a generally annular electrical contact, said housing comprising an outer shell having opposed top and bottom walls, a cavity disposed within said outer shell and dimensioned to receive the contact, a generally cylindrical hub having opposed top and bottom portions, with the bottom portion of said hub being integrally joined to said top wall of said outer shell by a generally annular strip of material, and with the top portion of said hub extending outwardly from said outer shell, said generally annular strip of material being dimensioned to shear when said hub is urged into said cavity, a first generally cylindrical aperture being formed in the bottom wall opposite said hub, the bottom portion of said hub being dimensioned to fit snuggly into said first aperture when said hub is driven into said cavity.

5. The housing of claim 4 wherein said top wall is adapted to provide a second generally circular aperture into which the upper portion of said hub is adapted to snuggly fit after said hub is driven into said cavity.

6. The housing of claim 5 wherein said hub is provided with a substantially vertically disposed hole therethrough.

7. The housing of claim 6 wherein said upper portion of said hub is provided with a substantially horizontally disposed groove therethrough.

8. The housing of claim 5 further comprising tab means secured to said outer shell and extending outwardly therefrom.

9. A process for forming an electrical connector comprising:

disposing a generally annular electrical contact in a cavity formed in an outer shell having a hub integrally joined to and extending outwardly from an upper surface of said outer shell; and driving said hub inwardly into said cavity such that said hub is sheared from said upper surface of said outer shell and such that said contact surrounds said hub.

10. The process of claim 9 wherein said steps of driving further include the step of leaving an aperture in said upper surface of said outer shell into which the upper portion of said hub snuggly fits after said hub is driven into said cavity.

11. The process of claim 10 wherein said step of disposing comprises the step of moving said contact into said cavity with shuttle means, and leaving said shuttle means in said cavity during the steps of driving.

12. The process of claim 11 further comprises the step of disposing a pin tool in a substantially vertical through-hole in said hub prior to, and during the steps of driving.

* * * * *